United States Patent [19]

Johnson

[11] 4,255,876

[45] Mar. 17, 1981

[54] ATHLETIC SHOE HAVING AN UPPER TOE SECTION OF STRETCHABLE MATERIAL, EXTERNAL REINFORCING STRIPS AND IMPROVED LACING

[75] Inventor: Jeffrey O. Johnson, Newton, N.H.

[73] Assignee: BRS, Inc., Beaverton, Oreg.

[21] Appl. No.: 44,241

[22] Filed: May 31, 1979

[51] Int. Cl.[3] ..... A43B 5/00; A43B 5/06; A43B 23/00; A43B 11/00

[52] U.S. Cl. ..... 36/83; 36/45; 36/50; 36/129

[58] Field of Search ..... 36/129, 83, 114, 45, 36/47, 48, 50, 51, 3 A

[56] References Cited

U.S. PATENT DOCUMENTS

| | | | |
|---|---|---|---|
| 716,528 | 12/1902 | Flowers . | |
| 955,337 | 4/1910 | Lawlor . | |
| 1,258,629 | 3/1918 | Bliss | 36/45 |
| 2,147,197 | 2/1939 | Glidden . | |
| 2,420,239 | 5/1947 | Hack . | |
| 3,138,880 | 6/1964 | Kunzli . | |
| 3,583,081 | 6/1971 | Hayashi . | |
| 3,768,182 | 10/1973 | Powers . | |
| 3,769,723 | 11/1973 | Masterson | 36/51 X |
| 3,793,750 | 2/1974 | Bowerman | 36/129 |
| 3,822,488 | 7/1974 | Johnson . | |

FOREIGN PATENT DOCUMENTS

| | | | |
|---|---|---|---|
| 7008511 | 6/1970 | Fed. Rep. of Germany . | |
| 1485624 | 10/1971 | Fed. Rep. of Germany | 36/129 |
| 2405091 | 8/1975 | Fed. Rep. of Germany | 36/129 |
| 778726 | 1/1935 | France | 36/45 |
| 501291 | 11/1954 | Italy | 36/45 |
| 782562 | 9/1957 | United Kingdom . | |
| 1170571 | 11/1969 | United Kingdom . | |

*Primary Examiner*—James Kee Chi

*Attorney, Agent, or Firm*—Klarquist, Sparkman, Campbell, Leigh, Hall & Whinston

[57] ABSTRACT

An athletic shoe is described including a shoe upper having a toe section and a main body section joined together and to a sole portion. Preferably the toe section extends forwardly of the metatarsophalangeal joints and is of a stretchable material to permit flexing of toes within the shoe, while the main body portion is of a nonstretchable material to restrict pronation of the rest of the foot. When the shoe is laced, first and second external reinforcing strips on the medial side of the upper, respectively exert pressure on the forward and rearward sides of the ball of the foot to restrict its motion. A third such strip on the other side of such upper limits the motion of the fifth metatarsophalangeal joint and urges the ball of the foot between the first and second strips. The first and third strips also join the toe and main body sections together without these sections overlapping. A special lacing arrangement preferably including alternating wide spaced and narrow spaced pairs of lace openings enhances the fit of the main body of the shoe. The first and third strips terminate in substantial alignment with different lace openings of a pair of widely spaced openings while the second strip terminates in substantial alignment with a lace opening of another widely spaced pair so that pressure exerted by the laces on the lace openings is distributed along the sides of the shoe. Consecutive pairs of narrow spaced lace openings are provided rearwardly of the arch of the shoe to also improve its fit. A widely spaced rearwardmost pair of lace openings is provided to draw the heel of the shoe inwardly against the heel of the foot when the shoe is laced.

14 Claims, 5 Drawing Figures

FIG. 1
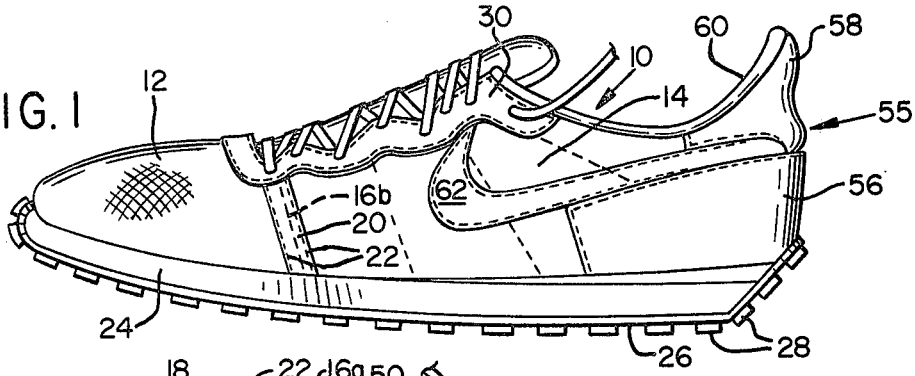
FIG. 2
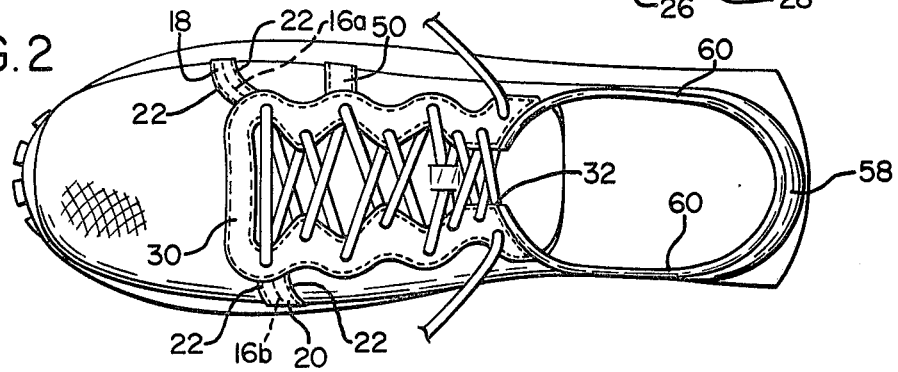
FIG. 3
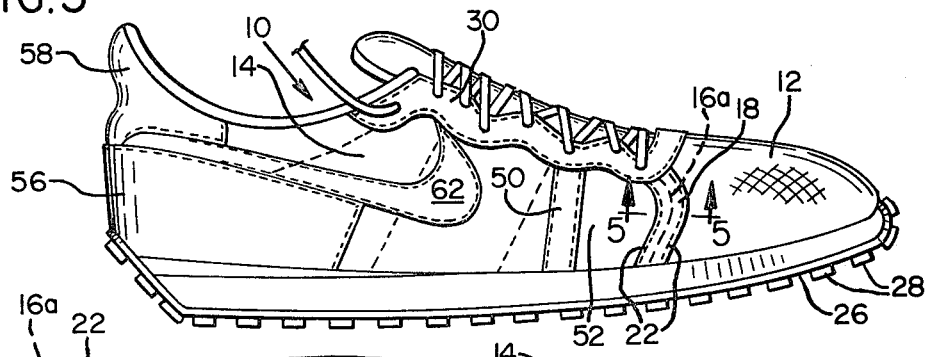
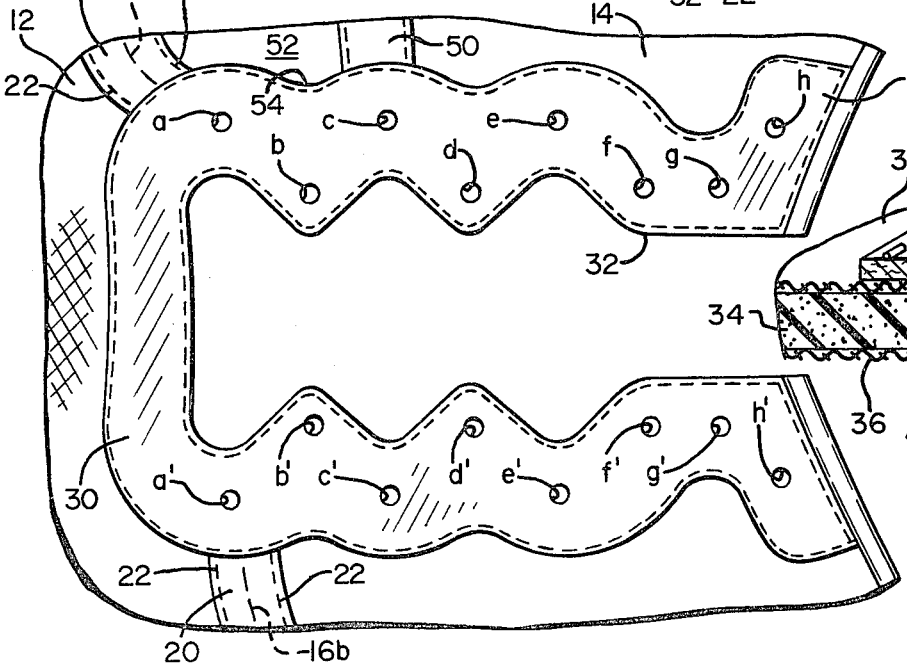
FIG. 4
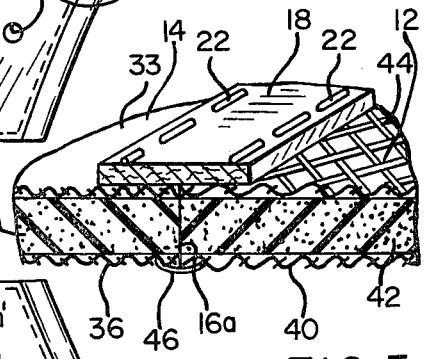
FIG. 5

ATHLETIC SHOE HAVING AN UPPER TOE SECTION OF STRETCHABLE MATERIAL, EXTERNAL REINFORCING STRIPS AND IMPROVED LACING

BACKGROUND OF THE INVENTION

The subject matter of the present invention relates generally to improved athletic shoes for various sports, such as track and field, football, baseball, basketball, tennis or the like, and particularly to such athletic shoes in which the upper portion of the shoe limits the motion of the portion of the foot rearwardly of the toes.

It is desirable to provide an athletic shoe with a toe upper section of a stretchable material to permit free movement of the toes and yet provide a comfortable and close fitting shoe. In contrast, to optimize the desired characteristics of the shoe, it is possible to provide a main body upper section rearwardly of the toes which is of a nonstretchable material so that movement of the rear portion of the foot is restricted. Consequently, undesired lateral motion of this portion of the foot during running is minimized and problems such as fatigue resulting from such motion are reduced. To further restrict movement of the ball of the foot, stabilizing members such as reinforcing strips can be positioned at the medial side of the shoe to distribute pressure from the laces forwardly and rearwardly of the ball of the foot. Another reinforcing member positioned on the other side of the shoe forwardly of the fifth metatarsophalangeal joint can also be provided to reduce undesired movement. The rigidifying and stabilizing effect of the shoe on the portion of the foot rearwardly of the toes can also be enhanced by way of improved lacing including staggered lace openings.

Conventional shoes have been made with an upper portion of differing materials. For example, the shoe disclosed in U.S. Pat. No. 3,822,488 of Johnson has a forward section of one material such as leather and a heel section of another material such as a synthetic fabric. However, in this prior shoe, the two upper sections are joined together approximately at the midpoint of the arch. Therefore, motion of the ball of a foot within this shoe is relatively unrestricted. Consequently, this shoe suffers from the disadvantages associated with shoes permitting undesired pronation of the foot rearwardly of the toes.

In another known shoe described in U.S. Pat. No. 3,138,880 of Kunzli, a one piece upper is provided with strips sewn along its sides. Each of these strips supports an eyelet ring for use in lacing the shoe so that reinforcing sections along the margins of the tongue opening are eliminated. Because of this one piece upper, this shoe has the drawback that no one material has all the characteristics necessary for an athletic shoe of best performance. In particular, it lacks a toe section of stretchable material as indicated above. In addition, it employs a relatively expensive construction in attaching eyelet rings to a shoe.

Staggered eyelets have been used in certain specialty shoes, such as shown in U.S. Pat. Nos. 2,420,239 and 716,528. However, staggered arrangements of lace openings are not known to have been employed in athletic shoes to improve the fit of the shoe upper to limit pronation of a rear portion of a foot within the shoe, nor which cooperate with reinforcing members along the sides of the shoe for this purpose.

SUMMARY OF THE INVENTION

It is, therefore, one object of the present invention to provide an improved athletic shoe having an upper shoe portion optimized for more desired characteristics by forming it to limit the movement of the portion of a foot rearwardly of the toes.

Another object of the invention is to provide an improved athletic shoe having a toe section generally forwardly of the metatarsophalangeal joints which is of a stretchable material so as to permit flexing of the toes, and which has a main body section rearwardly of the toe section designed to restrict pronation of the rear portion of the foot.

A further object of the invention is to provide an improved athletic shoe including a reinforcing member at the medial side of the shoe which exerts pressure along the forward and rearward sides of the ball of the foot to limit its movement.

Still another object of the invention is to provide another reinforcing member at the lateral side of the shoe for exerting pressure along the forward side of the fifth metatarsophalangeal joint to further restrict undesired movement of the rear portion of the foot.

A still further object of the present invention is to provide such an athletic shoe employing improved lacing for enhancing the fit of the upper portion of the shoe and which cooperates with reinforcing members to reduce undesirable pronation of the rear portion of the foot.

BRIEF DESCRIPTION OF THE DRAWINGS

Other objects and advantages of the present invention will be apparent from the following detailed description of a preferred embodiment thereof and from the attached drawings of which:

FIG. 1 is a side elevation view of the lateral side of a track and field shoe in accordance with one embodiment of the invention;

FIG. 2 is a top plan view of the shoe of FIG. 1;

FIG. 3 is a side elevation view of the medial side of the shoe of FIG. 1;

FIG. 4 is an enlarged view of a reinforcing member which defines lace openings along the sides of the tongue opening;

FIG. 5 is a section view taken along the line 5—5 of FIG. 4 on an enlarged scale showing a reinforcing strip covering the junction of two joined upper sections of different material.

DESCRIPTION OF PREFERRED EMBODIMENT

As shown in FIGS. 1, 2 and 3, a track and field shoe in accordance with one embodiment in the present invention has an upper shoe portion 10 including plural sections such as a toe upper section 12 and a main body upper section 14 made of different materials. The upper sections are joined together at the medial side of the shoe along a junction **16*a* and at the lateral side of the shoe along a junction 16*b*. Junction 16*a* is preferably positioned forwardly of and adjacent to the ball of a foot within the shoe and junction 16*b* is preferably positioned forwardly of and adjacent to the fifth metatarsophalangeal joint so that toe section 12** extends forwardly of the metatarsophalangeal joints.

Although sections 12, 14 may be secured together in any suitable manner in the preferred form, external reinforcing strips 18, 20 of a strong durable material such as leather are employed for this purpose. Strip 18 overlaps junction 16*a* and strip 20 overlaps junction 16*b* and are each secured to toe section 12 and main body section 14 along opposite sides of their associated junction in a suitable manner, such as by thread 22 of nylon or other high strength material. These upper sections 12, 14 are also joined to a multi-layered sole 24 which may include a synthetic rubber outer sole 26 having a plurality of circular projections or cleats 28 molded into its lower surface for better traction.

Strips 18, 20 may be employed on the shoe, for reasons explained below, even when not performing the function of joining the upper sections together. When employed, strip 18 is preferably positioned forwardly of and adjacent to the first metatarsophalangeal joint while strip 20 is preferably positioned forwardly of and adjacent to the fifth metatarsophalangeal joint. These strips are each connected at their lower end, to the sole of the shoe and at their upper end to a lace hole reinforcing member 30 which surrounds a tongue opening 32 and has plural lace openings therein as explained below.

As shown in FIG. 5, toe upper section 12 is preferably formed of a soft stretchable material to provide a comfortable fit for the toes and yet permit the toes to flex so as not to interfere with the driving force imparted by the toes during running. Toe upper section 12 may be formed of a "sandwich" of multiple layers of synthetic material. In one preferred form, the exterior layer 44 is of a synthetic mesh fabric, such as a nylon mesh with one millimeter openings between the strands forming the mesh. The mesh is supported by an intermediate layer 42 of a synthetic soft plastic or rubber foam material of approximately $\frac{1}{8}$ inch thickness. The foam layer is preferably sufficiently porous so that it "breathes" or passes air through for ventilation. Also, the foam layer is preferably the same color as the mesh so that the portion of it which is visible through the mesh does not detract from the overall appearance of the shoe. The interior side of the foam material is preferably backed by a thin woven abrasive-resistant lining such as nylon tricot fabric 40 to protect it from wear.

As also shown in FIG. 5, main body section 14 may include a woven synthetic material such as a nylon fabric in the form of a three layer "sandwich" of the type described in U.S. Pat. No. 3,793,750. This fabric includes a synthetic foam layer 34 between two woven synthetic fabric layers 36, 33 with the outermost layer 33 being of a nonstretchable material such as nylon or vinyl.

Preferably the materials forming main body section 14 and toe section 12 are of substantially the same thickness. In addition, the adjacent edges of the sections are formed to abut at junctions 16*a*, 16*b* so that, when the sections are joined together, discontinuities such as bulges are eliminated from the junctions of the materials. Stitching 46 may be provided to prevent the interior edges of these materials from parting so that a comfortable fit results.

Stretchable toe section 12 permits the toes to move freely during running and minimizes certain problems associated with shoes with stiff toes. One such problem that is minimized is a condition referred to as "black toe". This condition results from damage to the toenails of a foot connected to the rubbing of the toes against a nonstretchable material. At the same time, a nonstretchable material rearwardly of the metatarsophalangeal joints stabilizes the foot in this region and restricts undesirable pronation of this portion of the foot. Consequently, a more efficient running shoe is provided. In addition, when the shoe is laced, strips 18, 20 exert pressure along the heads of the first and fifth metatarsal joints to further isolate the movement of the toes from the rear portion of the foot and thereby restrict the pronation of this latter portion.

A second reinforcing strip 50, similar to reinforcing strip 18, is provided at the medial side of the shoe rearwardly of and adjacent to the first metatarsal head or ball of the foot. Strip 50 exerts pressure along the rearward side of the ball of the foot when the shoe is laced. Thus, strips 18, 50 cooperate to retain the ball of the foot between them and restrict its motion. In this manner, strips 18, 50 constitute one form of stabilizing means for restricting the motion of the ball of the foot. Also, strip 20 at the lateral side of the shoe urges the ball of the foot into the pocket or region 52 (FIG. 3) between strips 18, 50.

With reference to FIG. 4, a special arrangement of lace openings may be employed in the shoe and contributes to the stabilization of the rear portion of the foot. In this arrangement, strips 18, 20 and 50 are joined to lacing member 30 in substantial alignment respectively with a pair of first lace openings a, a′, and a third lace opening c. Consequently, when the laces are tightened the resulting stress applied to these lace openings is not localized at the openings, but instead is distributed along the strips to the sole. For this reason, strip 18 bears evenly on the front portion of the first metatarsal of a foot in the shoe while strip 50 bears evenly on the rear portion of this metatarsal, thereby enhancing the stability of the foot rearwardly of the toes. At the same time, strip 20 bears evenly on the head of the fifth metatarsal to further immobilize the rear portion of the foot.

In addition, strip 18 may be curved to follow the contour of the ball of the foot and thereby improve the fit of the shoe when laced.

The lace openings defined by lace member 30 are staggered so that the main body portion fits the foot more closely and comfortably when the shoe is laced.

The lace openings are arranged in plural wide sets and plural narrow sets of lace openings positioned alternately along the tongue. Each such set includes a pair of lace openings with each lace opening of the pair positioned at the opposite side of the tongue opening from the other. Thus, in the illustrated shoe with reference to FIG. 4, there are eight sets of lace openings. The first set nearest to the toe comprising openings a, a′, the second set comprising openings b, b′ and so on through the rearmost set h, h′.

The wide set openings comprise those sets with lace openings more widely spaced apart than the other, or narrow sets. Thus, sets a, a′; c, c′; e, e′ and h, h′ are wide set openings and the remaining sets are narrow set openings.

The first set of openings a, a′ is positioned with opening "a" in substantial alignment with the upper end of strip 20 and the third set of openings c, c′ are positioned with opening c in substantial alignment with strip 50 for reasons explained above. Also, by aligning these strips with openings of a wide set, pressure from the laces is applied to the strips at a point closer to the side edges of the shoe than if they were aligned with openings of a narrow set. This has been observed to provide a more comfortable fitting and stable main body section 14. Also, placement of a narrow set of openings b, b′ between sets a, a′ and c, c′ and indenting lace member 30 upwardly at 54 in the region of set b, b′ provides greater room for the ball of the foot between the lower edge of lace member 30 and the sole of the shoe.

Plural consecutive narrow sets of openings, in this case sets f, f' and g, g', are positioned rearwardly of the arch of the foot so that when the shoe is laced the upper encases a greater portion of this region of the foot. Also, the rearwardmost set of openings h, h' is wide set so that lacing of the shoe draws the heel 55 of the shoe forward against the foot.

It should be noted that heel reinforcing members 56, 58 of leather and vinyl, respectively, may be provided over the outer surface of the rear end or heel portion of the main body section 14 of the upper. Also, the vinyl member 58 has a pair of elongated ends 60 extending around the ankle opening in the top of the upper 10. Finally, a decorative strip 62 of vinyl of contrasting color may be sewn over the main body section 14, which serves as the identifying symbol or trademark of the assignee of the present invention. However, it is obvious that this strip 62, as well as the reinforcing members 56 and 58 can be eliminated from the shoe.

It will be obvious to those having ordinary skill in the art that many changes may be made in the details of the above-described preferred embodiment of the present invention without departing from the spirit of the invention. Therefore, the scope of the present invention can only be determined by the following claims.

I claim:

1. An athletic shoe in which the improvement comprises:

an upper shoe portion formed of a toe section and a main body section jointed together and joined in a sole portion;

said toe section extending generally forwardly of the metatarsal phalangeal joints of a foot positioned within the shoe and being formed of a stretchable material so as to facilitate flexing of the toes of the foot;

said main body section being of a nonstretchable material for at least partially immobilizing the portion of the foot rearwardly of the toes;

said upper portion defining a tongue opening and including a lacing portion which defines lace openings along the sides of the tongue opening;

said upper portion also including first and second reinforcing strips extending from said sole portion to said lacing portion, said first strip being positioned adjacent to and forwardly of the ball of a foot positioned within the shoe and said second strip being positioned adjacent to and rearwardly of the ball of the foot, said first and second strips together defining a pocket therebetween for receiving the ball of the foot such that said first strip exerts pressure along the forward side of the ball within the pocket and said second strip exerts pressure along the rearward side of the ball when the shoe is laced to thereby restrict pronation of the ball of the foot.

2. An athletic shoe in accordance with claim 1 in which said toe section is of a synthetic woven fabric with an outermost layer comprising a layer of a synthetic mesh material.

3. An athletic shoe in accordance with claim 2 in which said main body section is of a synthetic woven fabric.

4. An athletic shoe in which the improvement comprises:

an upper shoe portion formed of a toe section and a main body section jointed together and joined to a sole portion;

said toe section extending generally forwardly of the metatarsal phalangeal joints of a foot positioned within the shoe and being formed of a stretchable material so as to facilitate flexing of the toes of the foot;

said main body section being of a nonstretchable material for at least partially immobilizing the portion of the foot rearwardly of the toes;

said toe section and said main body section being positioned with their adjacent edges in abutting nonoverlapping relationship at a junction where they are joined, said shoe also including a first external reinforcing strip overlapping and joining together said toe section and said main body section along the portion of the junction at the medial side of the shoe and a second external reinforcing strip overlapping and joining together said toe section and said main body section along the portion of the junction at the lateral side of the shoe, said toe section and said main body section being of materials of substantially the same thickness at least in the region of the junction so that the inner surface of the shoe in the region of the junction is substantially smooth.

5. An athletic shoe in accordance with claim 1 including a third reinforcing strip extending from said sole portion to said lacing portion, said third strip being positioned adjacent to and forwardly of the fifth metatarsophalangeal joint of the foot such that said third strip exerts pressure along the forward side of and restricts motion of the fifth metatarsophalangeal joint when the shoe is laced, whereby said first, second and third strips cooperate in the immobilization of the portion of the foot rearwardly of the toes.

6. An athletic shoe in which the improvement comprises:

a sole portion;

an upper portion joined to the sole portion and defining a tongue opening, said upper portion having a lace portion which defines lace openings along the sides of the tongue opening;

said upper portion also including rigidifying means for at least partially immobilizing the ball of the foot when the shoe is laced, said rigidifying means extending along the medial side of the shoe from said sole portion to said lacing portion and including means defining a pocket for receiving the ball of the foot and for exerting pressure along the forward and rearward sides of the ball of the foot within the pocket when the shoe is laced to thereby at least partially immobilize the ball of the foot.

7. An athletic shoe in accordance with claim 7 which also includes second rigidifying means extending along the lateral side of the shoe from said sole portion to said lacing portion and substantially opposite said first rigidifying means, said second rigidifying means comprising means for exerting pressure on the lateral side of the foot when the shoe is laced so as to urge the ball of the foot into the pocket and against said first rigidifying means.

8. An athletic shoe in which the improvement comprises:

a sole portion;

an upper portion joined to the sole portion and defining a tongue opening;

a lace reinforcing member mounted to said upper portion along the tongue opening and defining lace openings adjacent the side edges of such tongue opening;

first and second external spaced apart reinforcing strips mounted to the medial side of the shoe and extending from said sole portion to said lacing member, said first and second strips together defining the boundaries of a pocket positioned for receiving the ball of a foot within the shoe, the first of said strips extending generally along the forward side of the ball of a foot inserted in the shoe and the second of said strips extending generally along the rearward side of the ball of the foot;

a third external reinforcing strip mounted to the lateral side of the shoe and extending from said sole portion to said lacing portion, said third strip extending generally along the forward side of the fifth metatarsal phalangeal joint of the foot;

said first and second strips cooperating to exert pressure along the forward and rearward sides of the ball of the foot when the shoe is laced to at least partially immobilize the ball of the foot in the pocket between them, and said third strip exerting pressure along the lateral side of the foot when the shoe is laced to at least partially immobilize the fifth metatarsal phalangeal joint and to urge the ball of the foot into the pocket between said first and second strips.

9. An athletic shoe in accordance with claim 8 in which said first strip is curved to conform to the contour of the ball of the foot.

10. An athletic shoe in accordance with claim 8 in which said strips each terminate at an upper end substantially in alignment with a lace opening to distribute along the sides of the shoe the pressure at the lace opening which results from lacing the shoe.

11. An athletic shoe in accordance with claim 8 in which said lace member defines plural wide sets and plural narrow sets of lace oenings with each said set including a pair of lace openings with each lace opening of the pair positioned along the opposite side of the tongue opening from the other, the openings forming each wide set being more widely spaced apart than the openings forming each narrow set, said lace openings being arranged with a plurality of alternating wide set and narrow set lace openings so as to facilitate the fit of the shoe when laced;

and in which the first set of lace openings nearest the toe of the shoe is a wide set, the second set of lace openings adjacent to and rearwardly of the first set is a narrow set, and the third set of lace openings adjacent to and rearwardly of the second set is a wide set; and said first strip is connected to said lace member in substantial alignment with the lace opening of the first set at the medial side of the tongue opening, said second strip is connected to said lace member in substantial alignment with the lace opening of the third set at the medial side of the tongue opening and said third strip is connected to said lace member in substantial alignment with the lace opening of the first set at the lateral side of the tongue opening.

12. An athletic shoe in accordance with claim 11 having a wide set of lace openings as its rearwardmost set such that tightening of shoe laces threaded through said rearwardmost set draws the heel of the shoe forwardly against the heel of the foot.

13. An athletic shoe in accordance with claim 11 or 12 having plural consecutive narrow sets of lace openings rearwardly of the arch of the foot with no wide sets of lace openings therebetween.

14. An athletic shoe in which the improvement comprises:

a sole portion;

an upper shoe portion formed of a toe section and a main body section joined together and to the sole portion; said upper portion also defining a tongue opening;

said toe sections extending generally forwardly of the metatarsophalangeal joints of a foot positioned within the shoe and being formed of a stretchable material so as to facilitate flexing of the toes of the foot;

said main body section being of a less stretchable material than said toe section to restrict movement of the foot rearwardly of the toes;

a lace hole reinforcing member mounted to said upper portion along the tongue opening and defining lace openings adjacent the side edges of such tongue opening;

first and second external spaced apart reinforcing strips mounted to the medial side of the shoe and extending from said sole portion to said lace hole member, the first of said strips extending generally along the forward side of the ball of the foot and joining together the toe section and main body section at the junction between these sections at the medial side of the shoe, said first strip being curved to conform to the shape of the forward side of the ball of the foot, the second of said strips extending generally along the rearward side of the ball of the foot;

a third external reinforcing strip mounted to the lateral side of the shoe and extending from the sole portion to the lacing member, said third strip extending generally along the forward side of the fifth metatarsophalangeal joint of the foot and joining together the toe section and main body section at a junction between these sections at the lateral side of the shoe;

said first and second strips cooperating to exert pressure along the forward and rearward sides of the ball of the foot when the shoe is laced to at least partially immobilize the ball of the foot between them, and said third strip exerting pressure along the lateral side of the foot when the shoe is laced to at least partially immobilize the fifth metatarsophalangeal joint and to urge the ball of the foot between said first and second strips;

said lace hole member defining plural wide sets and plural narrow sets of lace openings with each said set including a pair of lace openings with each opening of the pair positioned along the opposite side of the tongue opening from the other, the openings forming each wide set being more widely spaced apart than the openings forming each narrow set, said lace openings being arranged with a plurality of alternating wide set and narrow set lace openings, the first set of lace openings nearest the toe of the shoe being a wide set, the second set of lace openings adjacent to and rearwardly of the first set being a narrow set and the third set of lace openings adjacent to and rearwardly of the second set being a wide set;

said first strip being connected to said lace hole member in substantial alignment with a lace opening of the first set at the medial side of the tongue opening, said second strip being connected to said lace hole member in substantial alignment with a lace opening of the third set at the medial side of the tongue opening, and said third strip being connected to said lace hole member in substantial alignment with the other lace opening of the first set at the lateral side of the tongue opening;

said lace hole member defining a wide set of lace openings as the rearwardmost set such that tightening of shoe laces threaded through said rearwardmost set draws the heel of the shoe forward against the heel of the foot, said lace hole member also defining plural consecutive narrow sets of lace openings rearwardly of the arch of the foot and forwardly of said rearwardmost set.

* * * * *

UNITED STATES PATENT AND TRADEMARK OFFICE

CERTIFICATE OF CORRECTION

PATENT NO. : 4,255,876

DATED : March 17, 1981

INVENTOR(S) : Jeffrey O. Johnson

It is certified that error appears in the above–identified patent and that said Letters Patent are hereby corrected as shown below:

Column 6, line 53, change "7" to --6--;

Column 7, line 39, change "oenings" to --openings--.

Signed and Sealed this

*Thirteenth* Day of *October 1981*

[SEAL]

*Attest:*

GERALD J. MOSSINGHOFF

*Attesting Officer*

*Commissioner of Patents and Trademarks*